US006270277B1

(12) United States Patent
Ogino et al.

(10) Patent No.: US 6,270,277 B1
(45) Date of Patent: Aug. 7, 2001

(54) APPLICATOR

(75) Inventors: Nobuaki Ogino; Tsutomu Saito, both of Tokyo (JP)

(73) Assignee: First Create Co., Ltd., Tokyo (JP)

( * ) Notice: Subject to any disclaimer, the term of this patent is extended or adjusted under 35 U.S.C. 154(b) by 0 days.

(21) Appl. No.: 09/512,065

(22) Filed: Feb. 24, 2000

(30) Foreign Application Priority Data

Feb. 25, 1999 (JP) ..... 11-2088
Feb. 25, 1999 (JP) ..... 11-2089
Feb. 25, 1999 (JP) ..... 11-2090

(51) Int. Cl.[7] ..... A46B 17/04

(52) U.S. Cl. ..... 401/269; 401/262; 401/268; 401/284; 401/291

(58) Field of Search ..... 401/183, 186, 401/262, 269, 268, 271, 282, 284–286, 288, 290, 291; 222/490, 494, 550; 215/237, 228, 390, 391

(56) References Cited

U.S. PATENT DOCUMENTS 2,947,015 * 8/1960 Burt ..... 401/268
4,221,494 * 9/1980 Kachur ..... 401/213
4,752,015 * 6/1988 Schumacher ..... 401/269
4,974,984 * 12/1990 Kafkis et al. ..... 401/268
5,727,892 * 3/1998 Baudin ..... 401/263
6,123,477 * 9/2000 Hecker ..... 401/186

FOREIGN PATENT DOCUMENTS 10-179832 * 7/1998 (JP) .

* cited by examiner

*Primary Examiner*—Gregory L. Huson
*Assistant Examiner*—Tuan Nguyen
(74) *Attorney, Agent, or Firm*—Young & Thompson

(57) ABSTRACT

An applicator comprising a container containing an application liquid and an applicator member of the application liquid held to an opening provided in part of the container, wherein the applicator member comprises an application face material and a cover ring for engaging the application face material with the container, and at least in the central region of the outer surface of the application face material, a plurality of flexible fine protruding from the outer surface of the applicator member are arranged, and at the same time, at least in part of clearances between a plurality of the fine filament like portions in the outer surface of the application face member, holes for discharging the application liquid are provided, and the application face material and the cover ring are composed with different synthetic resins, and provides remarkable durability and convenience.

13 Claims, 8 Drawing Sheets

APPLICATOR

BACKGROUND OF THE INVENTION

1. Field of the Invention

The present invention relates to an applicator which contains liquids such as paste, adhesive, shoe polish, cosmetics, etc. and is used by discharging the liquid little by little from the top end with a cap removed.

2. Description of the Related Art

For general applicators, an application face material is attached to the opening of the container containing liquid such as paste, adhesive, shoe polish, cosmetics, etc. therein, and for this application face material, urethane sponge, or sponge with cloths laminated on urethane, or foam rubber sponge is used.

These sponges have effects to discharge a suited volume of a liquid contained in a container.

However, in the applicator of this kind of construction, there were defects in that the application surface was worn out, peeled off, or hydrolyzed and the durability was short.

In addition, in order to improve the durability, there was also a problem in that the manufacturing cost increased.

Furthermore, the convenience of the applicator itself should not be impaired.

Therefore, it is an object of the present invention to provide an applicator which not only provides excellent durability and convenience but also reduces the manufacturing cost by simplifying the manufacturing process.

It is the other object of the present invention to provide an applicator equipped with an application face material which discharges a suited volume of liquid discharged from the container by plastically deforming a plurality of fine filament like portions protrudably mounted on a peripheral area of the top center thereof and achieves further improved durability and smooth application.

It is another object of the present invention to provide an inexpensive applicator by improving still more durability and reducing the manufacturing cost.

Although by another previous invention related to the present invention, a durability of the conventional applicator, which is weak point thereof, had been improved some extent, in order to implement an intention for producing further better products, it is another object of the present invention to figure out the most suitable pattern and design of the fine filament like portion provided on the application face material and it's most suitable diameter or numbers of the holes for discharging the liquid, depending upon the respective applications, through experimental tests using prototype application, so as to make amount of discharged liquid suitable and to provide an applicator for smooth application of liquid.

SUMMARY OF THE INVENTION

The present invention adopts the basic technological configuration as shown below in order to achieve the above-mentioned objects. That is, a first aspect of the present invention relates to an applicator which comprises a container for containing the application liquid and an applicator member of the application liquid which is held to the opening provided at part of the container, wherein the applicator member comprising an application face material and a cover ring for engaging the application face material to the container, and further wherein at least in the center area of the external surface of the application face material, a plurality of flexible fine filament like portions being provided on and protruded from the outer surface of the application face material and at the same time, holes for discharging the application liquid being provided on at least a part of portions formed on said external surface of said application face material and among said plurality of fine filament like portions, and further wherein said application face material and the cover ring being composed of different synthetic resins In the second aspect of the present invention, an application has such a configuration in that a tip end of the fine filament like portion is directed to the vicinity of the center portion of the applicator member.

DETAILED DESCRIPTION OF THE PREFERRED EMBODIMENTS

Figure 1:
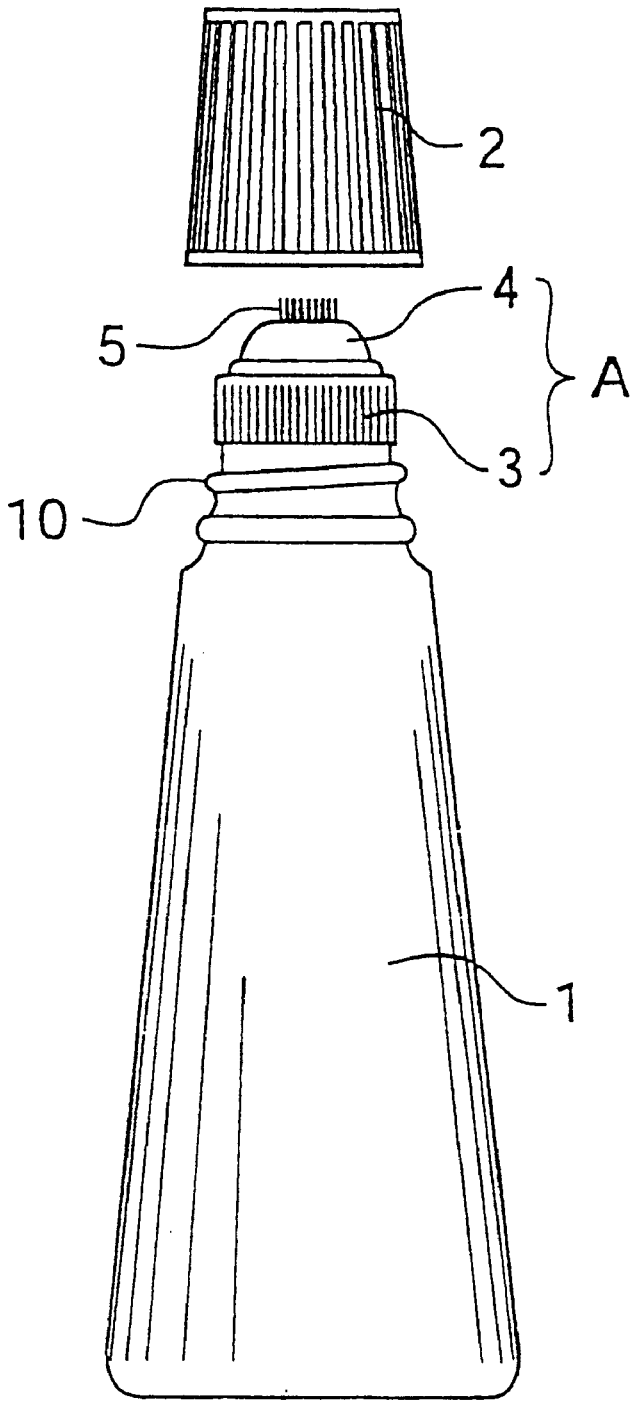
FIG. 1 is a front view showing the overall configuration in the applicator of the present invention.

The overall configuration of the applicator according to the present invention is such that at an opening of the container 1 containing the application liquid, an applicator member A is held, as shown in FIG. 1. In the vicinity of the opening of the container 1, a male thread 10 is formed, and a cap 2 fits to the male thread 10 so as to cover the applicator member A. In addition, the applicator member A comprises an application face material 4 and a cover ring 3 which engages the application face material 4 with the container 1.

Figure 2:
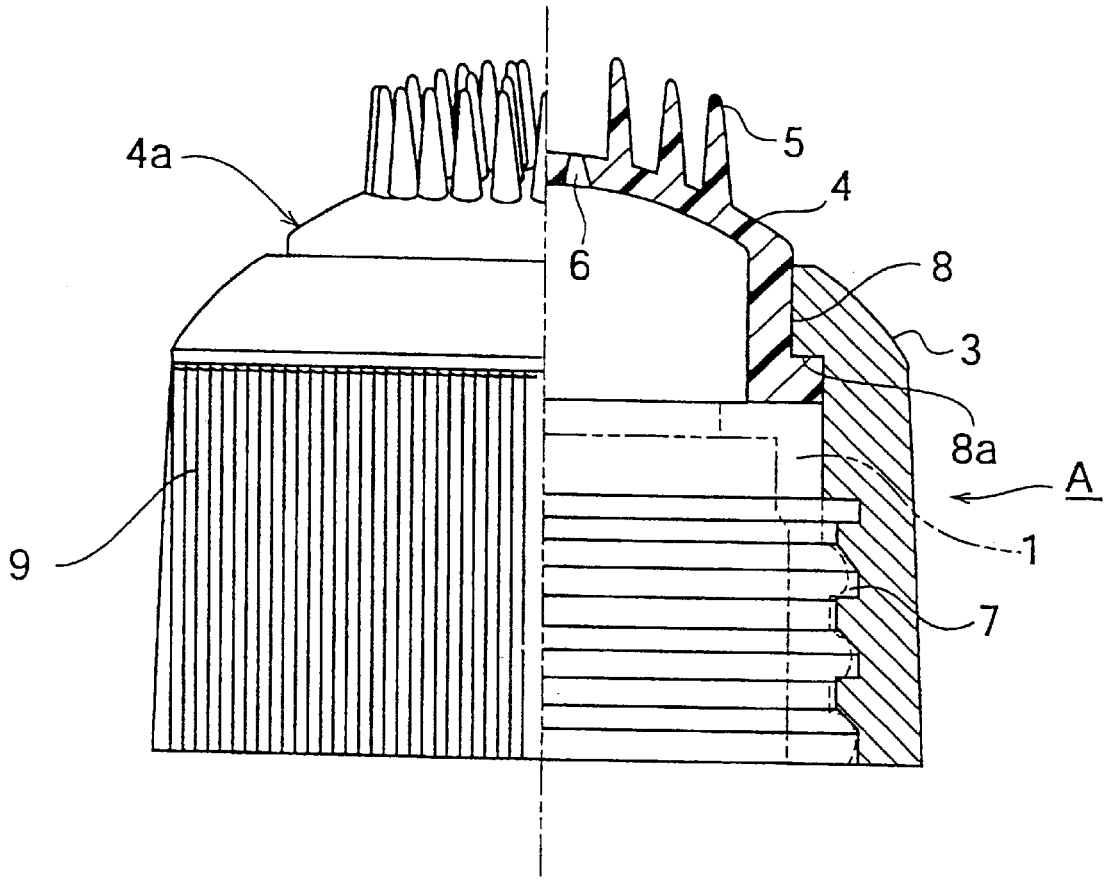
FIG. 2 is an enlarged front view partly broken away to show the applicator member used for the applicator according to the present invention.

FIG. 2 is an enlarged front view with partially broken away showing the applicator member A of the applicator according to the present invention. In FIG. 2, at least in the center region of the outer surface of the application face material 4, a plurality of flexible fine filament like portions 5 are arranged on and protruded from the outer surface of the application surface material. The fine filament like portion 5 may be cylindrical with uniform diameter or may be conical, in which the diameter at the base end portion is greater than that of at the tip end portion thereof.

The application face material 4 has the center region raised in the form of a dome, and at least a part of portions formed on said external surface of said application face material and among said plurality of fine filament like portions, holes 6 for discharging the application liquid are provided. In addition, to the peripheral portion 4*a* excluding the center region of the application face material 4, there secured is a region in which neither fine filament like portion 5 nor hole portion 6 is provided.

In the circumferential region of the center region in the application face material 4, and there exist a region in which the fine filament like portions 5 only are formed, but the hole portion 6 is not formed.

In addition, the application face material 4 and the cover ring 3 are formed with different synthetic resins, and there are cases in which the applicator container is formed by assembling the cover ring 3 into the application face material 4 after molding them separately, and in which they are integrally formed by coinjection molding.

The cover ring 3 is made of hard synthetic resin and the application face material 4 is made of soft synthetic resin, and when they are simultaneously formed by the coinjection molding process, the contacting surface 8 is melt-bonded in the stable condition at the time of molding. Even when they are molded separately, because the cover ring 3 and the application face material 4 are engaged with each other at the stepped section 8*a* and the opening section of the container 1, there is no problem in that the application face material 4 will be removed off from the cover ring 3 even when any external force is applied to the application face material 4.

At the inside below of the cover ring 3, a male thread 7 for fitting to the top end portion of the container 1 is formed. Around the outer circumference of the cover ring 3, longitudinal fine grooves 9 are formed. Consequently, it is easy to tighten or untighten the thread when the applicator member A is mounted to or removed from the container 1.

Figure 3:
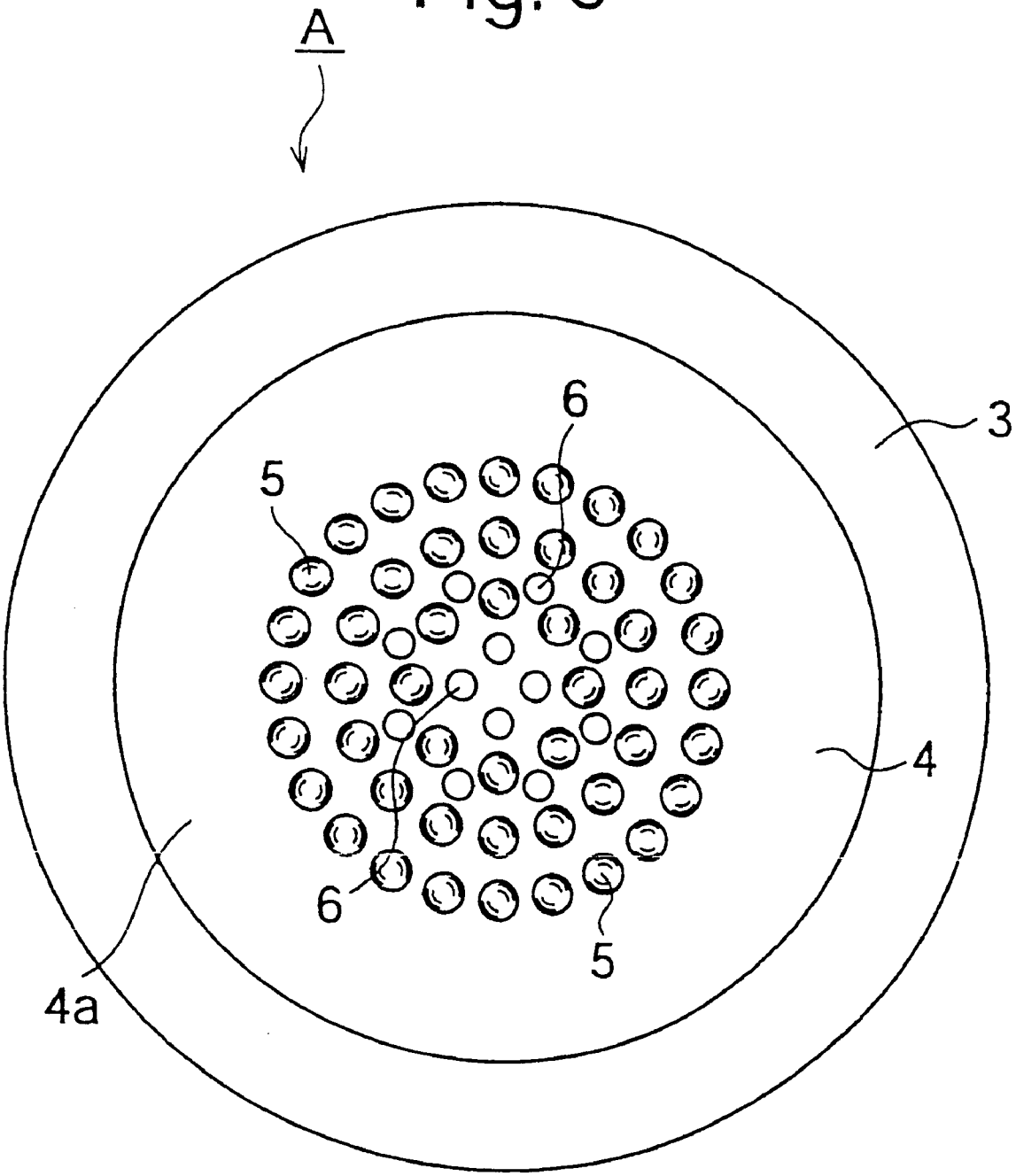
FIG. 3 is an enlarged plan view showing the applicator member used for the applicator.

FIG. 3 is an enlarged plan view showing the applicator member A of the applicator according to the present invention. At the center region of the application face material 4, a plurality of flexible fine filament like portions 5 formed with soft synthetic resin are provided. In addition, a part of portions formed on said external surface of said application face material and among said plurality of fine filament like portions at least, a hole 6 for discharging the application liquid is provided. On the peripheral region in the center region of the application face material 4, fine filament like portions 5 only may be formed. And at the peripheral portion 4*a* excluding the center region of the application face material 4, a region in which both fine filament like portions 5 and hole 6 are not provided exists. With this peripheral portion 4*a*, a liquid leakage prevention circumferential wall 11 of the cap comes into contact.

Figure 4:
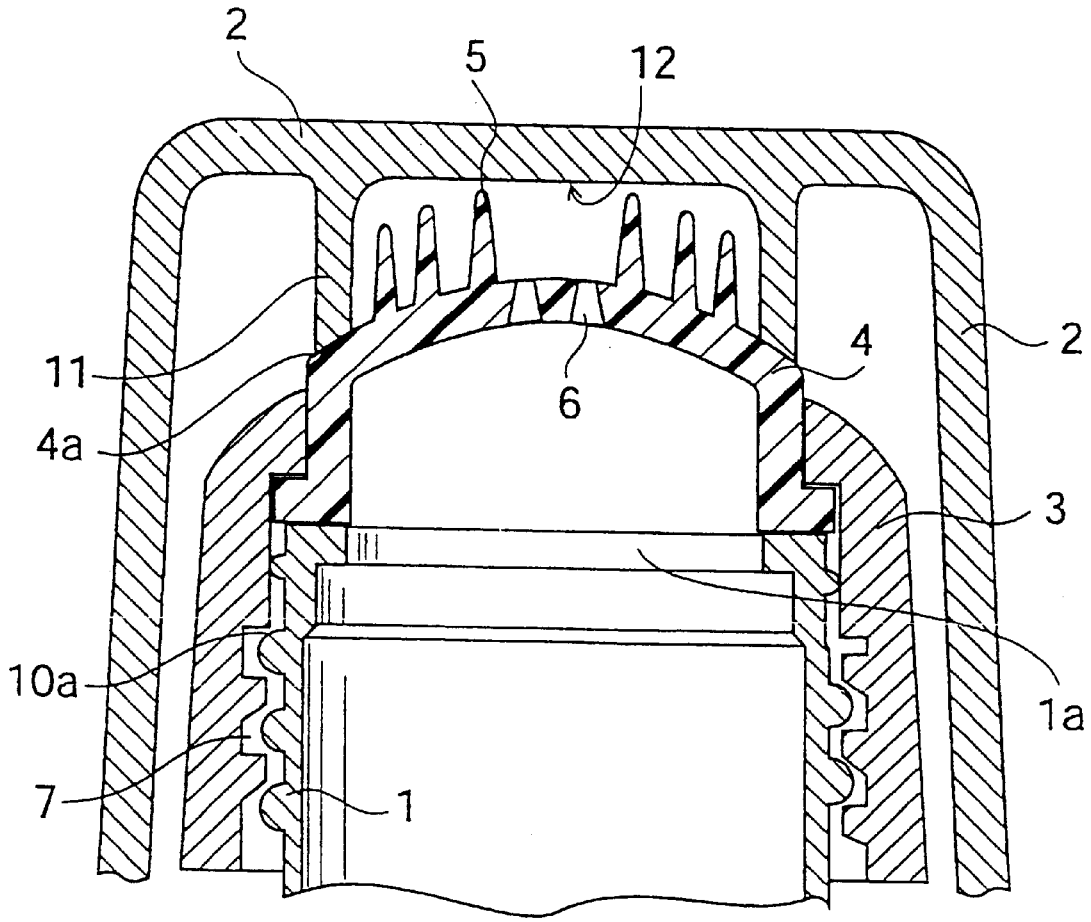
FIG. 4 is an enlarged cross-sectional view of the top section of the applicator showing the first embodiment of the present invention.

FIG. 4 is an enlarged cross-sectional view of the head portion of the applicator showing the first embodiment according to the present invention. The example shown in this figure indicates the condition in which the cap 2 is mounted to the container 1. The cap 2 has a liquid leakage prevention circumferential wall 11 vertically formed on the inside surface of the top section of the cap 2. In the present embodiment, the height of the liquid leakage prevention circumferential wall 11 may be set at a value with that even when the tip end of the liquid leakage prevention circumferential wall 11 reaches the peripheral portion 4*a* of the application surface material 4, the tip end of the fine filament like portions 5 arranged on the application face material 4 does not come into contact with the ceiling portion 12 of the cap 2. At the lower end and inside of the cap 2, a female thread is formed to engage with the male thread 10 formed at the top end of the container 1.

Next explanation will be made on the usage of the applicator formed as described above. As shown in FIG. 4, when the cap 2 is securely tightened so as to mount to the container 1, the liquid leakage prevention circumferential wall 11 vertically formed on the inner surface of the cap 2, comes into contact with the peripheral portion 4*a* of the application face material 4 and hermetically seals the applicator, thereby the liquid inside the container will not leak, even if the container 1 is tumbled down.

When the applicator is used to apply the liquid such as paste, the cap 2 is removed from the container 1, and the liquid is applied to the applied member with the application face material 4 while the liquid is being discharged from the hole portion 6 with the applicator member A directing below. Because on the application face material 4, a plurality of flexible fine filament like portions 5 made of soft synthetic resin are arranged, the discharged liquid is able to be smoothly applied. In addition, the fine filament like portion section 5 provides higher durability than conventional urethane sponge, sponge with urethane laminated with cloths, or urethane rubber sponge are used as the same object, and is free from the problems arisen in conventional application in that the application face material is worn-out, peeled off or hydrolyzed.

In addition, even when the liquid (paste, etc.) remaining between fine filament like portions 5 may be dried, it would not adhere to the fine filament like portions 5 or to the application face material 4, and thus is able to be easily removed by hand.

Furthermore, because when the cover ring 3 is engaged with the top end of the container 1, the tip end portion of the container 1 presses the lower end stepped portion of the application face material 4, the application face material 4 is able to be securely mounted on the cover ring 3. On the other hand, the container 1 and the applicator member A are connected to each other by engaging the male thread 10*a* formed on the tip end portion of the container with the female thread 7 formed inside the cover ring 3.

Figure 5:
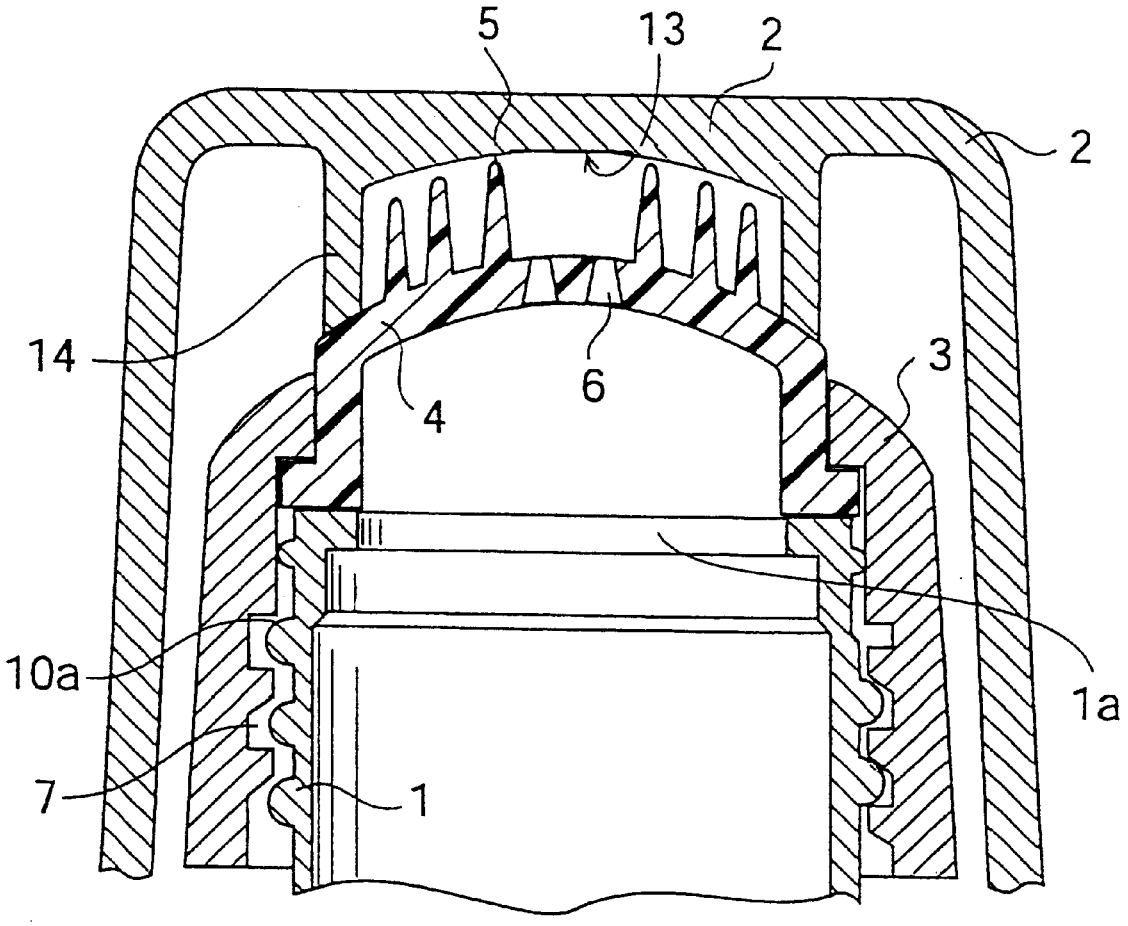
FIG. 5 is an enlarged cross-sectional view of the top section of the applicator showing the second embodiment of the present invention.

FIG. 5 is an enlarged cross-sectional view of the head portion of the applicator showing the second embodiment of the present invention. In the embodiment, to the ceiling portion of the inner circumferential surface of the cap 2, a spherically curved ceiling portion 13 is formed. The liquid leakage prevention circumferential wall 14 has a size nearly equivalent to the height of the fine filament like portions 5. That is, since the application face material 4 bends in the form of a dorm and at the same time the fine filament like portions 5 arranged on the surface are of the nearly same height, the tip end portion of the fine filament like portions 5 forms a nearly spherical profile.

Consequently, when the liquid is applied to the workpiece to be applied, the application operation can smoothly take place because the tip end of fine filament like portions 5 is spherical.

Figure 6:
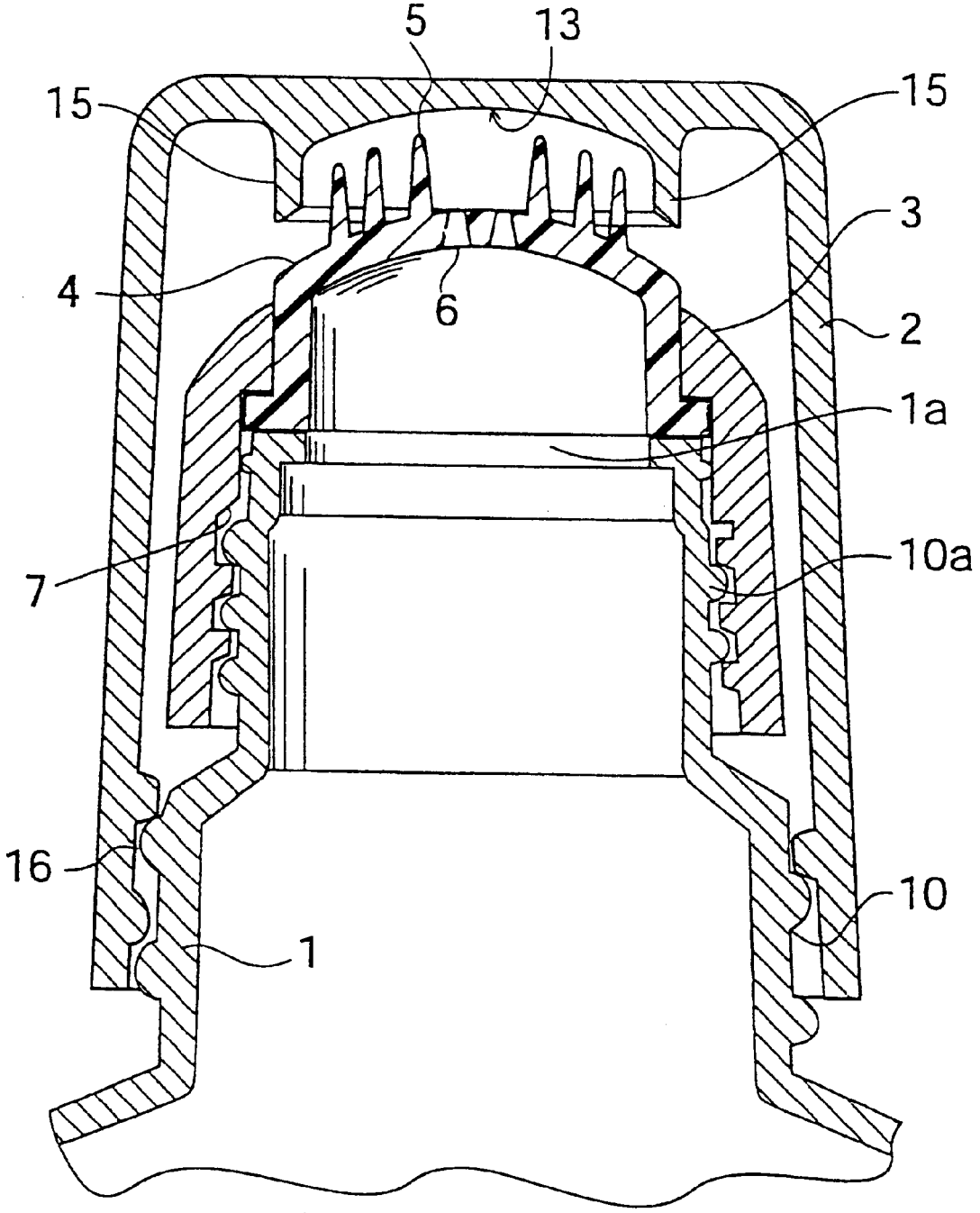
FIG. 6 is a longitudinal sectional view showing the condition in which the applicator according to the third embodiment of the present invention has a cap placed on before it is tightened.
Figure 7:
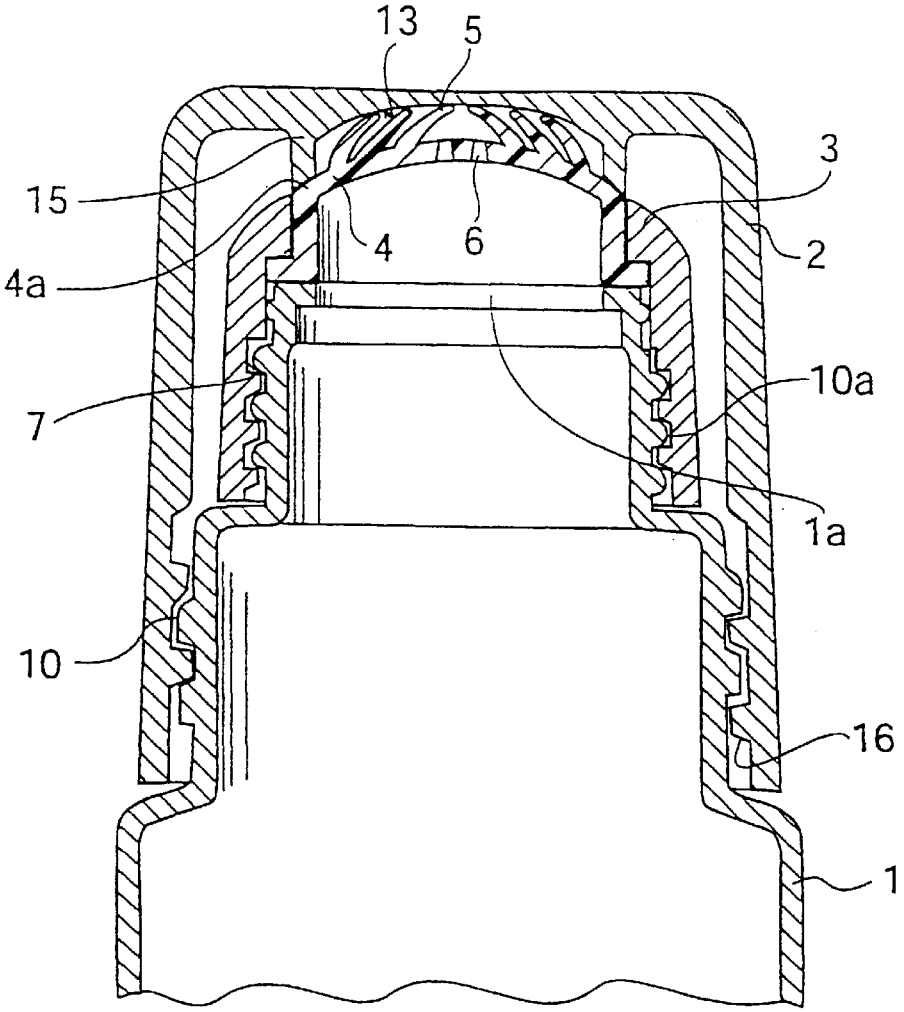
FIG. 7 is a vertical cross-sectional view showing the condition in which the cap is tightened to the applicator according to the embodiment.

FIG. 6 and FIG. 7 show the third embodiment according to the present invention, and are vertical cross-sectional views showing the condition before and after tightening a cap 2 placed on the top of the container 1 to which the applicator member is engaged. In the present embodiment, at the ceiling portion of the inner circumferential surface of the cap 2, a spherical ceiling portion 13 is formed and at the same time, the liquid leakage prevention circumferential wall 15 is made shorter than the fine filament like portions 5. That is, when the cap 2 is completely mounted to the container 1, the fine filament like portions 5 are pressed and bent . Other configurations are same as other embodiments, and the description will be omitted.

At the lower end of the inner circumferential surface of the cap 2, a female thread 16 is formed to be engaged with the male thread 10 formed on the container 1.

Next explanation will be made on the usage of the applicator related to the present embodiment. First of all, when the liquid is applied, the cap 2 is removed, and with the application face material 4 facing down and, apply the liquid discharged from the hole 6 to the workpiece to be applied via fine filament like portions 5.

When the cap 2 is tightened, first of all, the cap 2 is successively tightened by hand from the condition shown in FIG. 6 where the cap 2 is just slightly-tightened, and this operation causes the male thread 10 formed at the top end of the container 1 to engage with the female thread 16 formed at the lower end of the inner circumference of the cap 2, allowing the liquid leakage prevention circumferential wall 15 to come into contact with the peripheral portion 4*a* of the application face material 4. At the same time, the spherical ceiling portion 13 in the inner circumferential surface of the cap 2 presses the fine filament like portions 5 and turn them down a direction facing a center of or in the vicinity of the center of the application face material 4, respectively. That is, the spherical ceiling portion in the inner circumferential surface of the cap 2 presses the tip end of the fine filament like portions 5 and turn them down in the center direction as shown in FIG. 7.

Furthermore, when the application face material 4 made by molding method with soft thermoplastic synthetic resin, if the cap 2 is held in tightened condition for certain time, the find filament like portions 5 are plastically deformed and do not recover to the original profile at the time of molding. The condition in which all the fine filament like portions 5 bent in the center direction, holds the profile like well maintained chrysanthemum petals, for example, and if they are applied to the surface to be applied, for example, when a stationery paste is applied to paper etc., remarkably smooth application operation is achieved.

In addition, the fine filament like portions 5 bent over the open hole 6 penetratedly provided among achieve a function as if they cover the hole portion, and there is no fear of liquid leakage even if the container 1 is tumbled and turned sideways.

Consequently, for example, in the case of stationery paste, the present invention is able to solve the disadvantage of conventional applicator in that when it is frequently used, an amount of the paste more than required of same is constantly held adhering to the whole application surface, or when it is not used for a while, the paste is dried and is difficult to be smoothly discharged.

Because when the cap 2 is engaged, the fine filament like portions 5 are pressed while being rotated, the fine filament like portions 5 may be allowed to incline in the rotating direction of the cap 2 and at the same time to be bent in the center direction. Holding the fine filament like portions under this kind of condition enables the fine filament like portions 5 to plastically deform in the condition in which they are bent in the center direction.

Figure 8A:
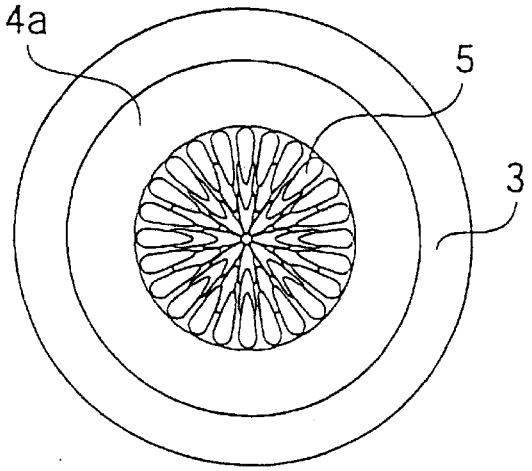
FIG. 8(A) is a plan view as seen from above of the condition of the applicator of FIG. 7 with the cap removed.
Figure 8B:
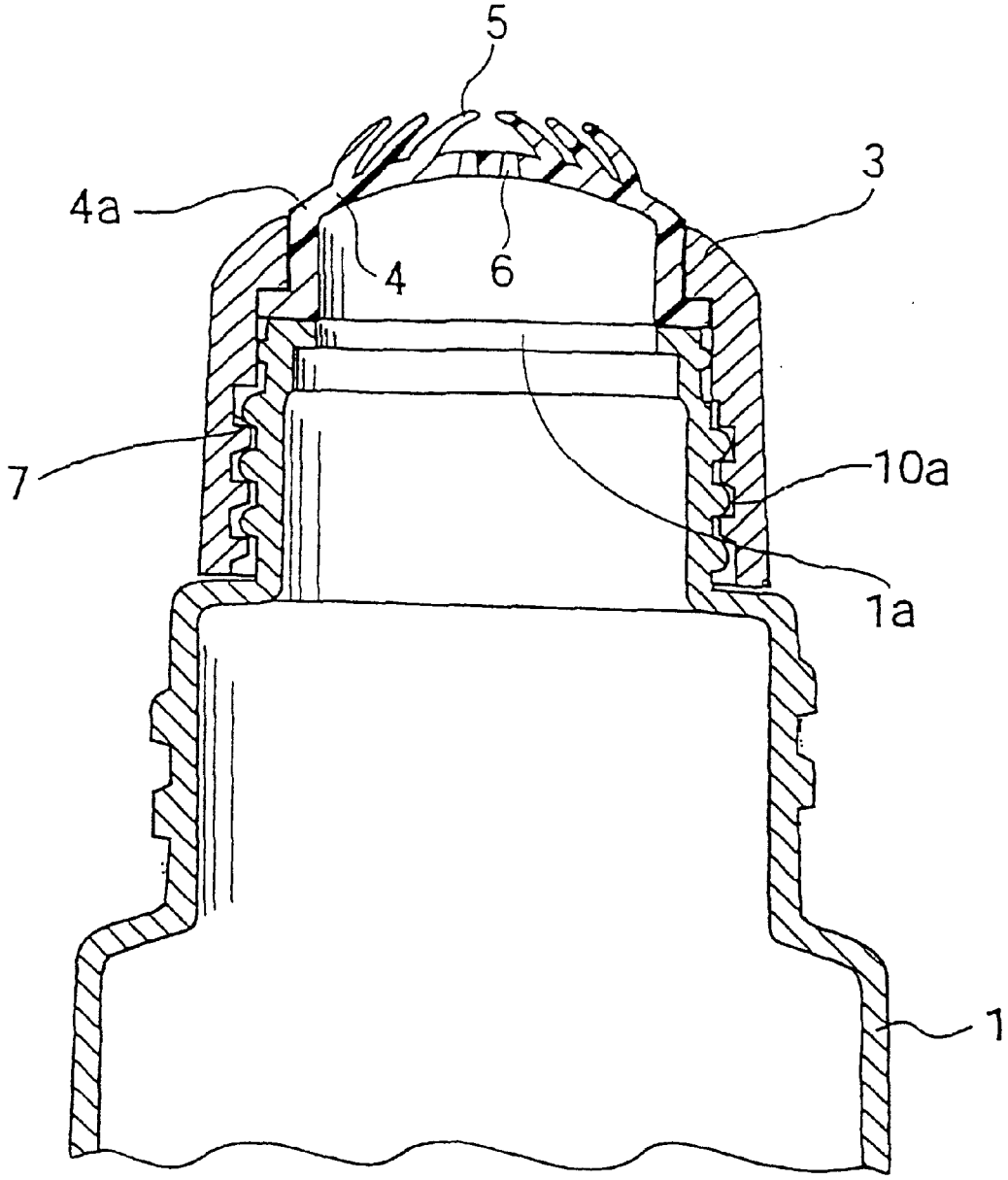
FIG. 8(B) is a longitudinal cross-sectional view of the applicator with the cap removed.

Specifically, as shown in FIGS. 8(A), (B), the tip end portion of fine filament like portions 5 may be formed to be directed to the vicinity of the center portion of the applicator member in advance. For the direction in which the fine filament like portions 5 are directed, the container 1 has a cap mounted in such a manner as to cover the application face material and the cover ring and at least the tip end portion of at least part of fine filament like portions 5 comes in contact with the wall portion inside of the top of the cap 2 to be mounted and is allowed to plastically deform in such a manner as to direct to the vicinity of the center portion of the applicator member. In addition, the fine filament like portions should not be limited to this case only but may be bent and deformed in advance by an iron or other heat-forming means.

Furthermore, the deformed profile of the tip end of the applicator member A may be formed along the tightening rotating direction of the cap 2 as seen planely from the outer surface side of the applicator member.

It is also possible to vary the number and the profile of the fine filament like portions 5, as well as the diameter and the number of holes 6 in accord with the volume of the liquid packed in the container 1. For example, with general stationery paste of about 30 ml to 100 ml content and about 10 mm application width of the container, the hole is desirable to have 0.3 mm to 0.7 mm diameter and 6 to 12 small holes. The fine filament like portions 5 should be desirably thin and be made in a large number.

In the case of an applicator which is used with adhesives with higher viscosity than liquid-form paste packed in the container 1 and has the application width of about 10 mm, the diameter of the hole 6 should be about 0.6 mm to 5 mm and the number of the hole should be 1 to around 6, and because the fine filament like portions 5 are required for physical strength, those thicker and in a larger number than in the case of general liquid paste packed are required.

On the other hand, when the container 1 is packed with a hair liquid and used, if the container for general household use has the application width around 10 mm, the diameter of the hole 6 should be around 0.6 mm to 5 mm and the number of holes should be about 1 to around 6. The fine filament like portions 5 should be made thick like a hair-cutting comb and have its number reduced.

What have been described are related to the container whose application width is around 10 mm, but if the application width is greater than that, the number of the fine filament like portions 5 and holes 6 should be increased, and when the application width is narrower, the number of the fine filament like portions 5 and holes 6 should be relatively reduced.

In the present invention, as described above, an application face material with a large number of fine filament like portions showing a needle-like profile formed by pile fabric, for example, arranged in the vicinity of the center portion of the top, and formed with small holes provided on at least a part of portions formed on said external surface of said application face material and among said plurality of fine filament like portions, and a cover ring are engaged with each other and mounted to the container and an external cap is attached to the container in such a manner to cover the application face material, and is rotated to tighten to the desired position. By doing this, the top inner surface of the external cap having spherically curved profile gradually presses the whole fine filament like portion as it is being tightened.

And the cap thereby causes a plurality of these fine filament like portions presses and bent in a direction along which the cap is rotated, while at the same time it also presses and bends in another direction facing a center of or vicinity of the center of the application face material. So that ultimately the fine filament like portions are deformed in a swirled condition.

And in the case of a molding in which this application face material is formed with soft thermoplastic synthetic resin, since it has a property not to recover the original form at the time of molding when it is plastically deformed by an external force, the condition in which all the fine filament like portions are tumbled down in the center inner direction achieves effects of holding a profile like a well maintained chrysanthemum, and thus it shows remarkably smooth application when the application face is brought in contact with paper, etc., for example, to apply stationery paste, and at the same time prevents the liquid from leaking even if the container is tumbled down and turned sideways because the fine filament like portions bent over small holes penetrately arranged among the fine filament like portion as if they cover small holes like lids.

Consequently, it has another effect of eliminating such conditions that in the case of a paste, when an applicator is used frequently as in the case of the conventional product, paste is held stuck fast over the whole application surface in the amount more than required, or when it is not used for a while, the paste dries up and is difficult to come out again.

Furthermore, because the application face material of the applicator according to the present invention as described above having a large number of fine filament like portions showing needle-like profile formed by pile fabric and has small holes for discharging liquid penetrately arranged and provided on at least a part of portions formed on said external surface of said application face material and among said plurality of fine filament like portions like in valleys between these fine filament like portions, while having an outer periphery regions located surrounding the top center of and in which no filament like portion nor such holes are provided, is integrally coupled to the container via suitable coupling means, when the liquid is applied, the liquid contained in the container such as pastes or adhesives ooze out from small holes of the application face material, is guided by the fine filament like portions located in the vicinity of the hole, and flows along the fine filament like portions, thereby the liquid is applied uniformly.

Unlike conventional applicators, in the present invention the application of the liquid does not take place with the whole application face material but with point contact surfaces of a large number of fine filament like portions arranged in the vicinity of the center of the top of the application face, thereby enabling the smooth application.

Furthermore, the application face does not wear out, peel off, or is not hydrolyzed, and the durability is greatly improved.

In addition, the present invention achieves an effect in that since the small holes are arranged concentratedly to the vicinity of the center portion of the top section, the application liquid is discharged concentratedly to the vicinity of the top section, and the discharged liquid is applied efficiently and uniformly on the whole workpiece to be applied as if it is caressed with a brush by the fine filament like portions arranged continuously and in a large quantity.

The diameter and the quantity of small holes for discharging the liquid deduced from prototypes and experiments, as well as the profile and the quantity of fine filament like portions provides an applicator which can make the amount of discharged application liquid suitable, respectively, in accordance with applications, and which is free of sticking and is able to achieve clean application.

There are two molding methods: one to separately mold in that application face material having a large number of fine filament like portions assuming needle form like pile fabric arranged around the center portion of the top section, and having a plurality of small holes for discharging the liquid which is provided or at least a part of portions formed on said external surface of said application face material and among said plurality of fine filament like portions are penetrately arranged in, and whose outer circumferential portion is a zone in which no fine filament like portions nor small holes are arranged, and a cover ring which serves to assemble and mount the application face material to the container are separately molded, and the other is a coinjection molding method in which the applicator is integrally molded. In the latter case, since the contact surface between the application face material and the cover ring which are made of two kinds of materials is fused to bond at the time of molding, the molding with an extremely stable quality is able to be obtained and because not only the durability is secured but also the operation to assemble the application face material with the separate cover ring as in the case of the conventional product is able to be eliminated, the manufacturing cost is reduced and an inexpensive applicator is able to be provided.

What is claimed is:

1. An applicator comprising:

a container for containing an application liquid; and an applicator member for applying the application liquid, said applicator member comprising, an application face having a convex outer surface and a plurality of flexible fine filament-like portions protruding from said convex outer surface, said flexible fine filament-like portions being integrally formed with said application face as a unit, a cover ring mounting said application face on an opening of said container, said application face and said cover ring being composed of different synthetic resins, and holes in said outer surface for discharging the application liquid, said holes being arranged among said plurality of fine filament-like portions.

2. The applicator according to claim 1, wherein said application face further comprises:

a center region and a peripheral region surrounding said center region, said holes being only in said center region.

3. The applicator according to claim 2, wherein said fine filament-like portions are only in said center region.

4. The applicator according to claim 2, further comprising:

a cap for mounting on said container and for covering said application face and said cover ring, and at least a tip end of each of said fine filament-like portions contacting an inner wall of said cap when said cap is mounted on said container and plastically deforming toward said center region.

5. The applicator according to claim 4, wherein said inner wall of said cap is concave.

6. The applicator according to claim 1, wherein said application face and said cover ring are integrally molded by coinjection molding.

7. The applicator according to claim 1, further comprising:

a cap;

a liquid leakage prevention circumferential wall vertically installed inside said cap, a tip end portion of said prevention circumferential wall contacting a peripheral portion of said applicator member when said cap is tightened, preventing the application liquid from leaking outside said cap.

8. The applicator according to claim 1, wherein said application face is formed by injection molding thermoplastic synthetic resin;

said holes number between 1 and 12, and an inside diameter of said holes is between 0.3 to 5.0 mm.

9. The applicator according to claim 1, wherein the application liquid is a liquid paste, said holes number between 6 and 12, and an inside diameter of said holes is between 0.3 to 0.7 mm.

10. The applicator according to claim 1, wherein the application liquid is an adhesive or hair liquid;

said holes number between 1 and 6, and an inside diameter of said holes is between 0.6 and 5.0 mm.

11. The applicator according to claim 1, wherein an application width of said applicator member is about 10 mm.

12. The applicator according to claim 1, wherein an application width of said applicator member increases as the number of said fine filament-like portions and said holes increases.

13. The applicator according to claim 1, wherein an application width of said applicator member decreases as the number of said fine filament-like portions and said holes decreases.

* * * * *